US005357866A

United States Patent [19]

Schluckebier et al.

[11] Patent Number: 5,357,866

[45] Date of Patent: Oct. 25, 1994

[54] JACKETED HOLLOW POINT BULLET AND METHOD OF MAKING SAME

[75] Inventors: David K. Schluckebier, Cabot, Ark.; Joseph W. Jakonczuk, Newark, Del.

[73] Assignee: Remington Arms Company, Inc., Wilmington, Del.

[21] Appl. No.: 109,552

[22] Filed: Aug. 20, 1993

[51] Int. Cl.[5] ..... F42B 12/34

[52] U.S. Cl. ..... 102/509; 102/514

[58] Field of Search ..... 102/507–510, 102/514–516, 517

[56] References Cited

U.S. PATENT DOCUMENTS

| | | | |
|---|---|---|---|
| 634,383 | 10/1899 | Webley | 102/509 |
| 1,730,871 | 10/1929 | Aronson | 102/509 |
| 1,944,884 | 1/1934 | Gerlich | 102/514 |
| 1,992,244 | 2/1935 | Schurecht | 102/514 |
| 3,143,966 | 8/1964 | Burns, Jr. et al. | 102/514 |
| 4,610,061 | 9/1986 | Halverson | 102/509 |
| 5,101,732 | 4/1992 | Schluckebier | 102/509 |
| 5,208,424 | 5/1993 | Schluckebier et al. | 102/509 |

FOREIGN PATENT DOCUMENTS

| | | | |
|---|---|---|---|
| 2344 | 12/1893 | United Kingdom | 102/507 |
| 17152 | 7/1899 | United Kingdom | 102/514 |
| 1110507 | 4/1968 | United Kingdom | 102/514 |

*Primary Examiner*—Harold J. Tudor
*Attorney, Agent, or Firm*—Donald W. Huntley

[57] ABSTRACT

A jacketed hollow point bullet having a lead core and the method of making same with the core having a downwardly extending cavity having side portions terminating adjacent the peripheral edge of the jacket, with slits being formed in the peripheral edge of the jacket and down through the adjacent side portions of the core.

4 Claims, 5 Drawing Sheets

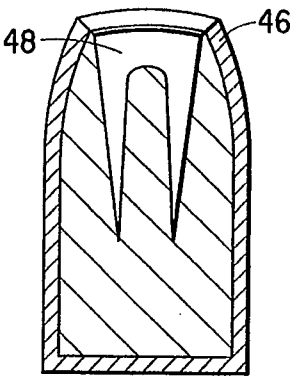
FIG. 5
(PRIOR ART)
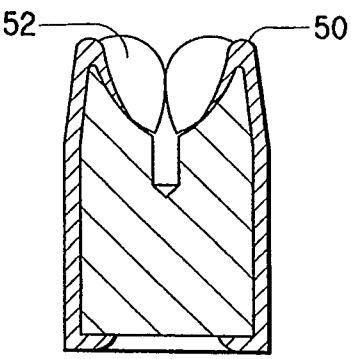
FIG. 6
(PRIOR ART)
FIG. 4
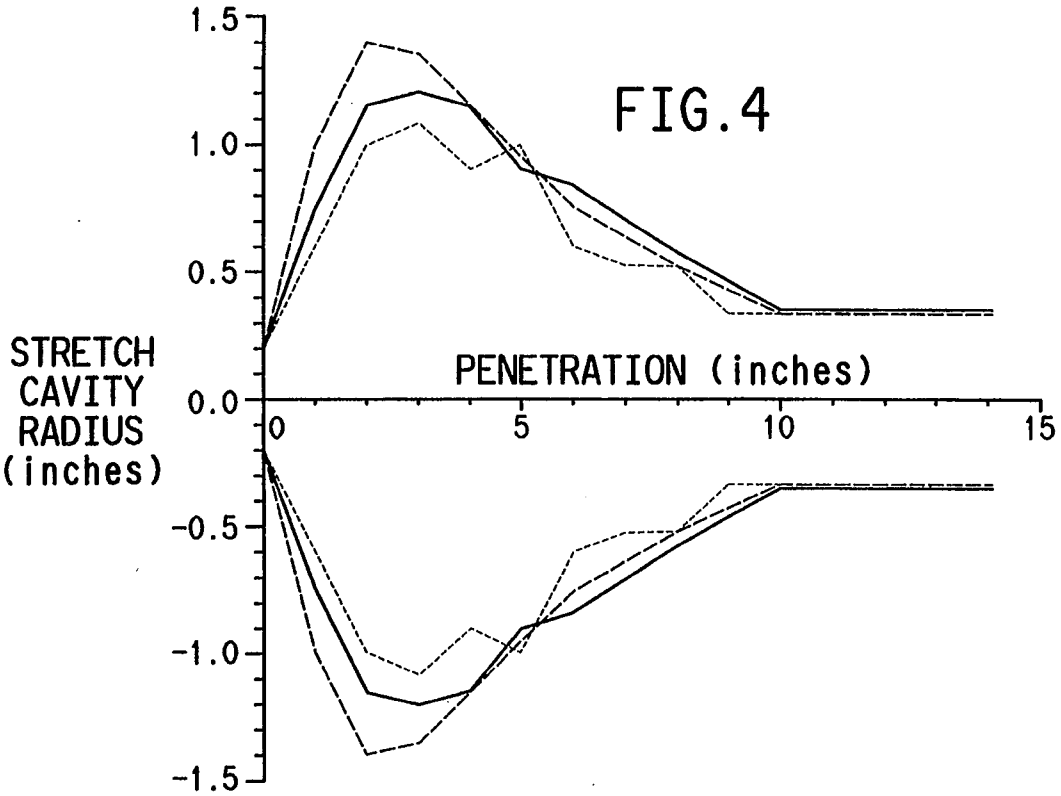

JACKETED HOLLOW POINT BULLET AND METHOD OF MAKING SAME

BACKGROUND

1. Field of the Invention

This invention relates to a jacketed hollow point bullet and method of making the bullet. The bullet has a lead core and brass jacket with the nose portion open with slits around the opening passing through the core and jacket. A boat tail bullet is formed by a five step cold forming process whereas the flat base bullet is formed in a four step process. Both bullet types have driving bands. In one embodiment, the nose cuts are at an angle to the longitudinal axis of the bullet.

2. Summary of the Prior Art

Mushrooming jacketed hollow point bullets are known in the art. U.S. Pat. Nos. 5,101,732 and 5,208,424 each disclose a hollow point bullet with the jacket passing around the core, including the open depression forming the hollow point. The core is exposed at the base and can be exposed in the bottom of the open depression. This results in the preformed jacket pedals turning inside out when the bullet penetrates a mass and mushrooms (see FIG. 6 of the 5,208,424 patent).

Other patents, such as U.S. Pat. Nos. 2,045,964, 2,321,345 and 2,327,950 disclose mushrooming bullets. U.S. Pat. No. 1,992,244 discloses a driving band.

SUMMARY OF THE INVENTION

The jacketed hollow point bullet has a lead core and brass jacket that terminates at the edge of the opening in the core forming the hollow point, with slits being formed through the jacket and the core at the edge of the core opening so that the core and jacket petals formed when mushrooming, separate, with the jacket petals expanding more than the core petals. In both a boat tail form and a flat bottom form, a driving band is provided.

In one embodiment, the slits (nose cut) are formed at an angle to the longitudinal axis of the bullet.

The method of making the boat tail and flat bottom bullet is a series of profile manipulations of the core and the open jacket.

BRIEF DESCRIPTION OF THE DRAWINGS

FIGS. 3*a* to 3*f* illustrate the various forms taken by the core and jacket while mushrooming;

FIG. 4 is a graphic representation of the stretch cavity of ordinance gelatin as the bullet passes through the gelatin; showing a comparison of the stretch cavity of the bullet of this invention with that of other hollow point bullets on the market (illustrated in FIGS. 5 and 6).

FIGS. 5 and 6 are illustrations of hollow point bullets presently on the market.

DESCRIPTION OF THE PREFERRED EMBODIMENT

Figure 1C:
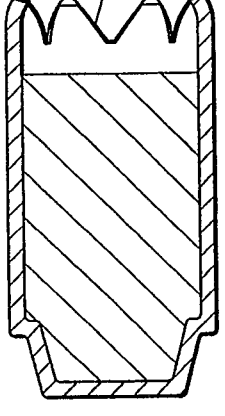
FIGS. 1*a* to 1*e* are cross-sectional views of the boat tail profile bullet showing the successive steps of profile manipulation to form the jacketed hollow point bullet of this invention.
Figure 1B:
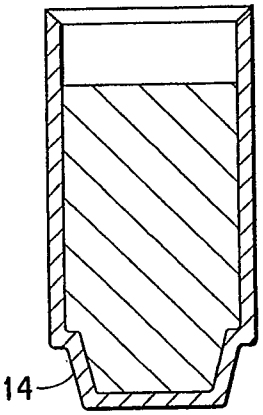
Figure 1A:
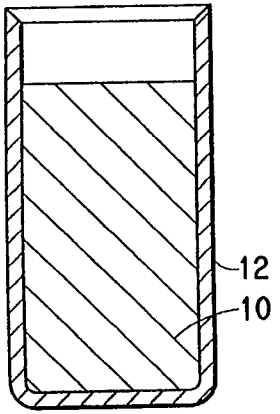
Figure 1F:
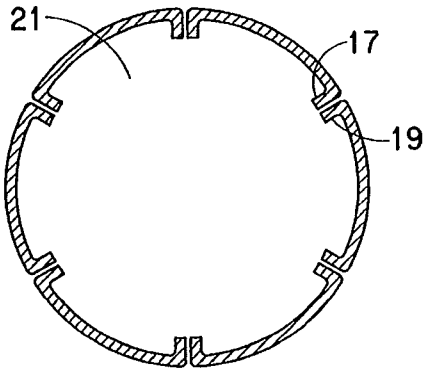
FIG. 1*f* is an enlarged cross-sectional view taken along the line 1*f*—1*f* in FIG. 1*d*.
Figure 1G:
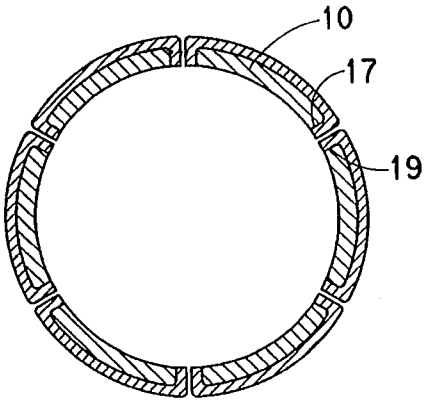
FIG. 1*g* is an enlarged cross-sectional view taken along the line 1*g*—1*g* in FIG. 1*e*.
Figure 1E:
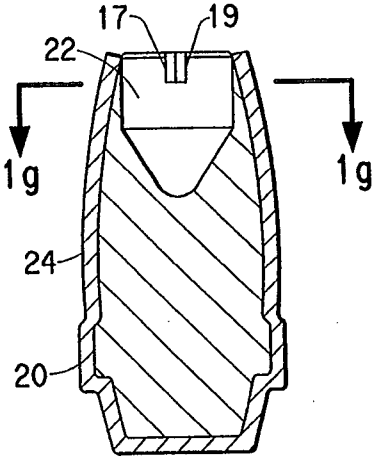
Figure 1D:
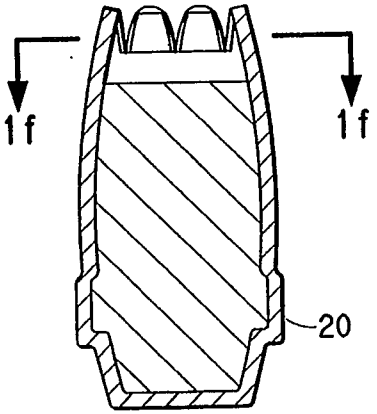

Attention is directed to FIGS. 1*a* to 1*e* which illustrate the various stations of the profile manipulation to form the boat tail bullet of this invention. In FIGS. 1*a* and 1*b* the lead core 10 is seated in the jacket 12 and the boat tail profile 14 is formed. In station 1*c* the nose cut 16 is formed. The nose cut die cuts entirely through the jacket with the configuration of nose cut die forming triangular flaps or petals 18 which facilitates curling the cut flaps 18 inwardly during the preform station (shown at FIG. 1*d*). In the station shown in FIG. 1*d*, driving band 20 is also formed. FIG. 1*e* illustrates the finish form station in which the final profile of the lead core is formed (inverted ogival 22) with the nose cut being formed entirely through both the core and jacket. FIG. 1*f* illustrates the opposed edges 17 and 19 of the nose cut flaps 18 being angled into the jacket opening 21. FIG. 1*g* illustrates that the edges 17 and 19 of flaps 18 extend all the way into the hollow point. By manufacturing a band on the finished bullet as shown, performance attributes are enhanced. One skilled in the art is able to increase the velocity of the load by as much as 5 to 10% or lower the peak pressure. The increased velocity directly provides a mushrooming performance advantage for a properly designed police and/or recreation bullet for a rifle or pistol. An advantage in penetration and/or expansion of a given bullet is realized by increasing the velocity. More velocity is achieved when the bullet is pushed easily out of the shellcase and engaged in the rifling. Since the smaller cylindrical portion 24 forward of the band approximates bore diameter, the bullet is allowed to move farther forward in the bore before it is solidly engaged by the driving band. This increases the chamber volume, thus lowers the pressure for a given propellant charge weight. If enough case capacity exists for more propellant to be added, an increased charge weight of propellant can be added to increase the velocity up to the pressure constraint. Besides increasing chamber volume, which is one source of the velocity increase, the bearing surface of the bullet is reduced to just the band, thus reducing engraving force. The resultant energy savings from this reduced engraving force contributes a velocity increase to the system also. It should also be noted that the band physically locks the jacket to the core. The concentric cylindrical configuration which results from the band also should be noted as improving accuracy. The forward smaller cylindrical section precisely aligns the bullet axis with the bore axis before engaging the rifling and provides match grade accuracy as a result.

In addition to the driving band feature, the nose of the bullet has a unique configuration also. Since the nose-cut is cut entirely through the jacket, the performance of the bullet is enhanced at the lower velocity levels. Conventional nose-cut bullets are normally folded notches instead of cut through which requires the folded notches to be broken open before the petals can be peeled back. In this sense, by the cut jacket petals passing into the hollow point it takes less force to expand the petals. When the petals open up during mushrooming, the stronger thicker material allow the petals to open farther in the radial direction before bending rearward. This action effectively increases the amount of stretch cavity in the target medium resulting in a larger energy deposit thus more trauma to target medium. The increased trauma increases the likelihood of possible hemorrhage to the target medium or tissue not directly in the wound path of the bullet.

Figure 2D:
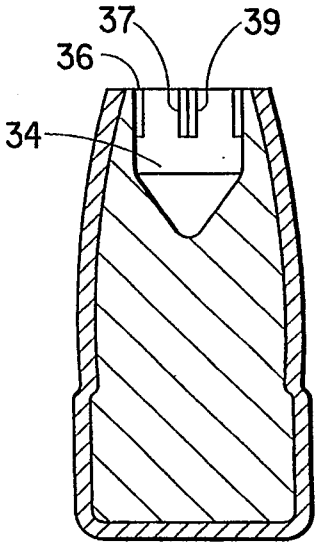
FIGS. 2*a* to 2*d* are cross-sectional views of the flat bottom profile bullet showing the successive steps of profile manipulation to form the jacketed hollow point bullet of this invention.
Figure 2C:
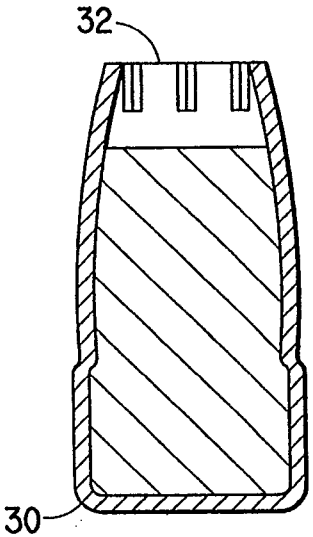
Figure 2B:
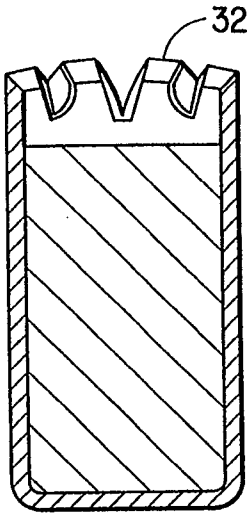
Figure 2A:
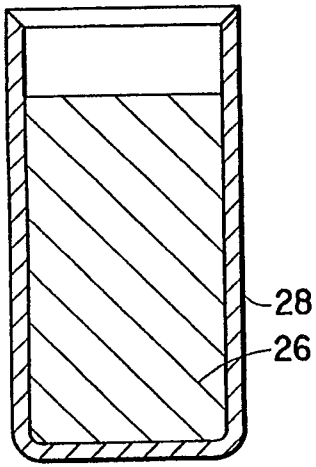
Figure 3C:
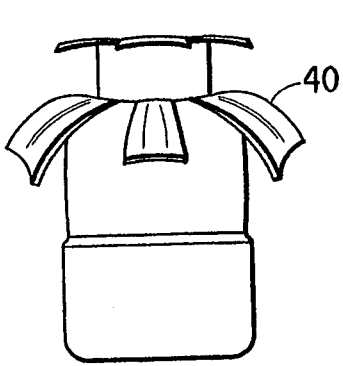
Figure 3B:
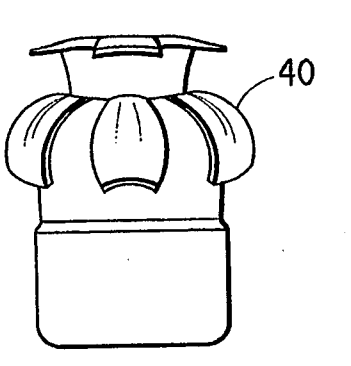
Figure 3A:
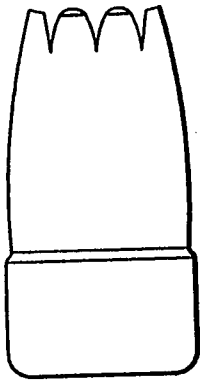
Figure 3E:
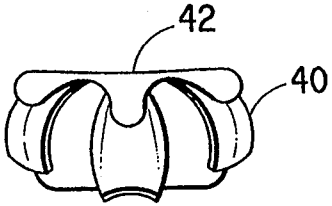
Figure 3E:
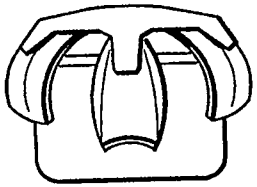
Figure 3D:
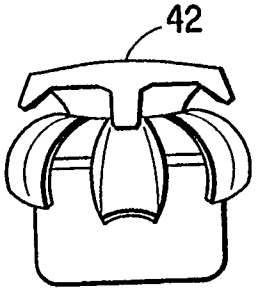

Attention is now directed to FIGS. 2*a* to 2*d* which illustrate the stations for producing the flat base bullet of this invention. FIG. 2*a* illustrates the lead 26 seated in jacket 28. FIG. 2*b* illustrates the nose cut station in which petals 32 are formed similar to the station illustrated in FIG. 1*c* and the prior comments concerning FIG. 1*c* apply to FIG. 2*b*. FIG. 2*c* illustrates the preform station in which driving band 30 is formed along with the edges of the petals being formed inwardly like in station 1*d*. FIG. 2*d* illustrates the finish form station in which the core profile of an inverted ogival shape 34 is formed along with closing the nose cuts 36 with the edges 37 and 39 passing entirely through both the jacket and the core. The above features discussed in connection with the driving band and nose cut equally apply to the flat base bullet illustrated in FIGS. 2*a* to 2*d*.

It should be noted that the jacket is formed from CDA 260 brass instead of 210 or 220 which is conventionally used as a jacket material. The jacket is also thicker than conventional hollow point jackets and is made from the stronger, more rigid, copper alloy 260. Similar effects can be attained from other suitable materials and alloys.

Reference is now made to FIGS. 3*a* to 3*f* which illustrate the manner in which the core and jacket deform as the bullet passes through ordinance gelatin (or target medium)—a soft medium standardized in the industry into which a bullet passes to determine the action in the medium in comparison to other bullet configurations. Initially the petal edges (17, 19 or 37, 39) (see FIG. 3*b* and 3*c*) move outwardly away from the core. As the bullet passes through the gelatin, the petals separate from the core 42 (shown in FIGS. 3*d* to 3*f*) in a convex curvature since the edges of the flaps deformed initially. Further, with the specially designed inverted ogival core configuration, the jacket deforms to a larger expanded diameter than the core.

FIGS. 5 and 6 illustrate other configurations of hollow point bullets with the jacket 46 on the bullet in FIG. 5 ending in a circular shape adjacent the core opening 48. In the configuration shown in FIG. 6 the jacket 50 is formed around the opening and down into the hollow point cavity 52.

FIG. 4 is a graphic illustration of the stretch cavity showing a comparison of the cavity configuration using the bullet of this invention (dotted line) in comparison to the bullet of FIG. 5 (dashed line) and the bullet of FIG. 6 (solid line). It should be noted that with the nose cut all the way through the jacket in the bullet in this invention, the petals initially open up sooner and form in a greater radial arc which consequently forms a larger initial stretch cavity, as illustrated in FIG. 4 (in comparison to other hollow point bullets illustrated in FIGS. 5 and 6).

Figure 7C:
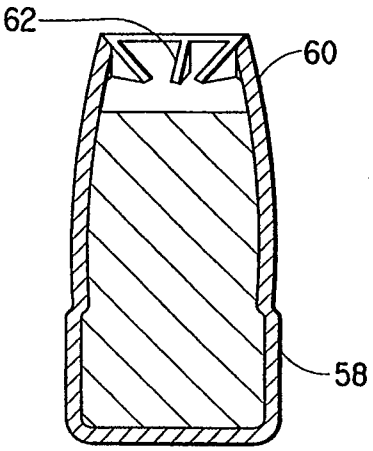
FIGS. 7*a* to 7*d* illustrate the nose cut at an angle to the bullet axis.
Figure 7F:
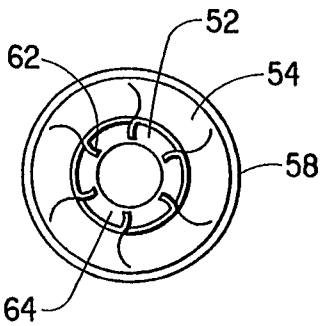
FIG. 7*f* is a top plan view of the embodiment in FIG. 7*d*.
Figure 7E:
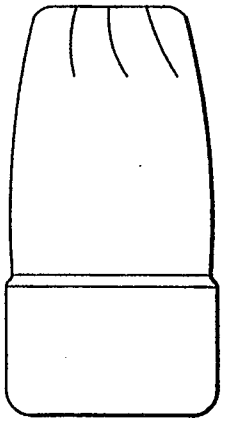
FIG. 7*e* is a side elevational view of the embodiment in FIGS. 7*a* to 7*d*.
Figure 7B:
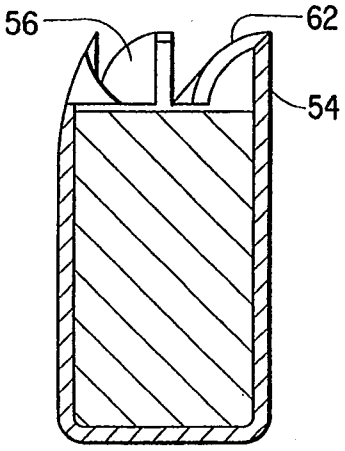
Figure 7D:
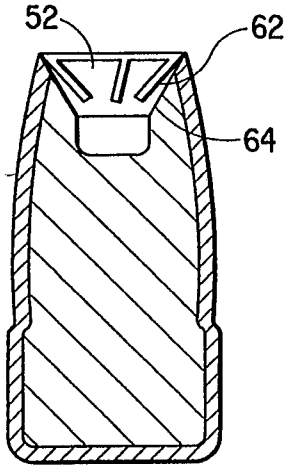
Figure 7A:
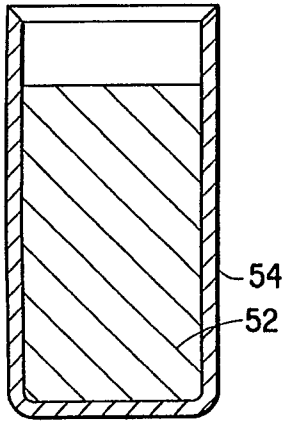

Attention is now directed to FIGS. 7*a* to 7*f* wherein the nose cut is cut entirely through both the jacket and core at an angle to the longitudinal axis of the bullet. FIG. 7*a* shows the lead core seat station in which the core 52 is seated in jacket 54. FIG. 7*b* illustrates the jacket 54 being cut and folded at an angle to form angularly disposed petals 56. In FIG. 7*c*, the driving band 58 is formed along with ogive 60. In FIG. 7*c* the side edges 62 of the petals 56 angularly extend into the jacket. FIG. 7*d* illustrates the finish form station in which the cavity profile 64 being formed in the core and shows the peripheral edges 62 of the petals 56 separating the formed forward core segments on the cavity profile surface 64. The cavity profile 64 has a two taper configuration. The concept is the same as shown in FIG. 1*g* except in FIG. 7*f* only one peripheral edge of the jacket extends into the cavity 64 instead of two side edges as in FIG. 1*g*.

FIGS. 7*e* and 7*f* respectively show a side view and top plan view of the bullet and illustrate the overlapping relationship of petals 56 in the ogive bullet nose. In this configuration, the nose cuts being finish formed at an angle are axially longer than the embodiment in FIGS. 1*g* and 1*e* with the cavity 64 being smaller. A special nose cut tool folds one triangular flap (on each petal) inward toward the bullet axis with the adjacent flap overlapping it (similar in appearance to the aperture of a camera). This provides the following advantages.

1) The inwardly folded flap can reach farther inward toward the bullet axis allowing a smaller hollow point cavity while still permitting the petals to extend outwardly further;

2) With the smaller hollow point cavity, the lead petals are thicker and resist breaking or separating at their hinge point with the core body, thus providing better core weight retention (less lead wash);

3) A smaller cavity has a smaller volume which increases the hydraulic pressure inside the cavity upon impact. The radial force is consequently increased on the cavity sidewalls; and, 4) By cutting the jacket and bending the triangular flap, the profiling of the bullet (FIGS. 7*c* and 7*d* preform and final form, respectively) eliminates metal thickening and work hardening of bullet nose by allowing the petals to fold over top of each other. Further, the energy needed to mushroom the bullet is further reduced by not having to overcome the added nose strength resulting from metal thickening and work hardening.

The embodiment of FIGS. 7*a* to 7*g* is preferred for lower velocity cartridges due to the low energy available for mushrooming.

The jacket material and nose design optimizes the "stretch cavity" made by the mushrooming bullet in a soft medium like ordinance gelatin. With the stronger material in the jacket and the thicker petals, the petals resist bending more and create more of a radial arc when mushrooming (see FIG. 3). Conventional bullets with weaker petal construction have more of a peeling (like a banana) action where the petal bends and slides down the projectile body. Consequently, the bullet with more of a radial petal swing during mushrooming, creates a larger "stretch cavity" in a soft medium like ordinance gelatin. The stretch cavity is defined as the tears and/or visual disturbance area in the gelatin surrounding the wound channel, which has not come in direct contact with the bullet.

It should also be noted that mushroom performance is enhanced by nose cutting the jacket and core (entirely through) which provides for consistent expansion over a wide range of velocities and in varying mediums. Deep medium penetration is achieved by minimizing lead core deformation through the core hollow point cavity 64 design configuration.

We claim:

1. A mushrooming hollow point bullet having a base and a lead core having a central recess in a front open end of the core, the core being surrounded by a jacket which has a front open end terminating at the front open end of the core, the improvement comprising a plurality of downwardly projecting spaced slits extending through the front open end of the jacket to form spaced petals having side edges extending through the front open end of the lead core into the central recess to form petals of core material and jacket material between the spaced slits and wherein the jacket material extends into the slits to said central recess which permits the petals of core and jacket material to separate and form outwardly projecting petals.

2. The bullet of claim 1 wherein the front open end of the core extends downwardly toward the bullet base and terminates in an inverted ogive configuration.

3. The bullet of claim 1 wherein the bullet has a base portion and a driving band near the base portion.

4. The bullet of claim 1 wherein said slits are at an angle to a longitudinal axis of the bullet to form angularly disposed petals that are overlapped.

* * * * *